US005664349A

United States Patent [19]

White et al.

[11] Patent Number: 5,664,349

[45] Date of Patent: Sep. 9, 1997

[54] REMOVABLE SOLE PLATE COVER FOR FABRIC PRESSING IRONS

[76] Inventors: Mark E. White; Glen R. Kealy, both of 29 Kibo Rd., Regents Park, Sydney 2143, Australia

[21] Appl. No.: 693,002

[22] Filed: Aug. 6, 1996

[51] Int. Cl.[6] ..... D06F 75/38

[52] U.S. Cl. ..... 38/97

[58] Field of Search ..... 38/74, 75, 80, 38/81, 93, 94, 96, 97, 98

[56] References Cited

U.S. PATENT DOCUMENTS

| | | | |
|---|---|---|---|
| 2,458,530 | 1/1949 | Resnick . | |
| 2,750,697 | 6/1956 | Jacobson | 38/97 |
| 2,990,635 | 7/1961 | Rogers | 38/97 |
| 3,142,916 | 8/1964 | Jacobson . | |
| 3,257,746 | 6/1966 | Cohen | 38/97 |
| 3,404,471 | 10/1968 | Wilsker et al. | 38/97 |
| 3,407,521 | 10/1968 | English . | |
| 3,905,138 | 9/1975 | Abolafia . | |
| 3,930,325 | 1/1976 | Schaeffer et al. . | |
| 4,209,921 | 7/1980 | Kochauf . | |
| 4,642,922 | 2/1987 | Prudenziati . | |
| 4,660,307 | 4/1987 | Fay . | |
| 4,665,637 | 5/1987 | Kramer . | |
| 4,747,222 | 5/1988 | Riba . | |
| 4,800,661 | 1/1989 | Yamamoto et al. . | |
| 4,856,212 | 8/1989 | Dikoff . | |
| 5,164,244 | 11/1992 | Mattesky . | |
| 5,165,184 | 11/1992 | Gardaz et al. . | |
| 5,165,185 | 11/1992 | Gardaz et al. . | |

*Primary Examiner*—Ismael Izaguirre
*Attorney, Agent, or Firm*—Richard C. Litman

[57] ABSTRACT

A removable sole plate cover for fabric pressing irons is formed of a thin, flat, planar sheet (approximately fifteen thousandths of an inch) of polytetrafluoroethylene (PTFE) material (e.g., Teflon, tm). The sheet is removably securable to the sole plate of a hand operated iron, and protects fabrics being pressed from burning, scorching, and polishing by reducing friction between the iron and the fabric and also providing for more even heat distribution from the sole plate to the article being pressed. The cover is removably secured to the iron by forward and rearward lateral flaps. The forward flaps each have an extension ear extending therefrom, which are folded to overlap one another and to secure to the corresponding forward flap of the opposite side. The rearward flaps each have at least one eyelet therein, and are folded upwardly along the edge of the iron sole plate and secured across the iron by one or more tensile springs. A myriad (approximately two hundred) of small steam vent holes, each approximately one sixteenth of an inch in diameter, are provided through the cover, generally in the conventional V-shaped pattern of steam vent holes customarily provided in hand operated steam irons. The large number of holes, and their distribution pattern, assures that at least some of the holes are aligned with the holes in the iron sole plate to allow passage of steam therethrough, without need for some additional internal structure (ridges, etc.) to space the cover away from the sole plate.

18 Claims, 3 Drawing Sheets

REMOVABLE SOLE PLATE COVER FOR FABRIC PRESSING IRONS

BACKGROUND OF THE INVENTION

1. Field of the Invention

The present invention relates generally to the ironing and smoothing of fabrics and clothing using hand operated flatirons, and more specifically to a cover which is removably attachable to the sole plate of such irons to protect materials being ironed from scorching, burning, or polishing during the ironing process. The cover is formed of a thin, planar polytetrafluoroethylene plastic sheet (e. g,, Teflon, tm) and conforms to the configuration of the specific iron sole plate to which it is removably attached by becoming soft and pliable due to the heat from the iron. Steam holes generally conforming to the typical pattern of steam vents in the sole plate of an iron are also provided through the thin sheet.

2. Description of the Prior Art

While the advent of synthetic fabrics and advances in manufacturing techniques for natural fabrics has resulted in clothing and other fabrics which are easier to care for than many fabrics in the past, the need to iron clothing and other fabrics to smooth and eliminate wrinkles, still exists. Similarly, advances in the art of hand held fabric pressing irons have also been achieved, which make the task easier.

Nevertheless, ironing clothing and other fabrics is a tiresome task, due to the necessary mass of such irons required to press out wrinkles in the fabric, and the friction between the sole plate of the iron and the underlying fabric. Iron manufacturers are well aware of this, and have made numerous attempts to manufacture irons which are easier to use, in order to develop more sales. While little can be done to remove the required mass for proper ironing, various improvements have been made in the reduction of friction between the sole plate and the underlying article being ironed, as by providing polished sole plates and plates coated with a low friction plastic material of some sort, such as a polytetrafluroethylene (PTFE, which abbreviation will be used throughout the remainder of the present disclosure) plastic compound, an example of which is sold under the trademark name Teflon by the DuPont Corporation. These plastic coatings of the metal iron sole plate also provide an additional advantage, in that they tend to provide more even heat distribution to reduce the likelihood of scorching or burning the fabric being ironed.

However, these PTFE plastics tend to be relatively soft, and will be abraded or worn away after some period of time. This leaves the bare metal sole plate exposed, with the disadvantages of such noted above. In fact, it may take a user some time to adjust to the different characteristics of the iron with the metal sole plate exposed, as opposed to a sole plate coated with PTFE. Also, many less expensive irons are not provided with a PTFE coating on the sole plate, for reasons of economy during manufacture.

Accordingly, a need will be seen for a removably attachable cover for hand held fabric pressing irons, which may be installed over a bare metal sole plate or over a previously plastic coated sole plate. The cover is formed of a thin sheet of PTFE plastic material, and is removably attachable to the iron. The very thin, planar sheet is heated by the iron, which causes the sheet to become pliable and to conform to the contours of the iron. Thus, only one size, or at the most a very few sizes and configurations, of such PTFE sheets need be provided, as they will conform to the specific shape of the iron (standard, smaller travel iron, etc.) to which they are secured. A plurality of steam vent holes should also be provided through the sheet, preferably in the general pattern of steam holes conventionally provided in the sole plate of steam irons. Such an iron cover may be installed to replace the worn plastic coating on an iron, or to provide such a coating for an iron not previously provided with such. The cover sheet may be removed and/or replaced as needed, serving to preclude or reduce the scorching, burning, snagging, and polishing of fabric materials being ironed. A discussion of such iron sole plate plastic covers which are known to the present inventors, is provided below.

U.S. Pat. No. 2,458,530 issued on Jan. 11, 1949 to David Resnick describes a Combing And Brushing Attachment For Sadirons, comprising an open rigid plate having plural transverse comb and/or brush elements extending across the bottom opening. This of course teaches away from the present smooth, thin, and resilient cover which covers the entire sole plate, with the exception of steam holes.

U.S. Pat. No. 3,142,916 issued on Aug. 4, 1964 to Sidney Jacobson describes an Accessory For Garment Steaming Devices, wherein a perforated metal plate is coated with a PTFE plastic on its underside. This composite plate is then removably secured to an iron, with the PTFE providing the advantages known in the use of such material. Jacobson, however, requires that the PTFE material be bonded to a rigid metal plate, rather than providing a thin sheet of PTFE material alone, as in the present invention. Manufacture of the present sole plate cover is facilitated also, as no separate metal plate and bonding step need be provided.

U.S. Pat. No. 3,407,521 issued on Oct. 29, 1968 to William A. English describes a Steam Iron having a slightly upwardly inclined nose or toe area of the sole plate, serving to concentrate weight in that area when the iron is tilted forwardly. No particular coating or removable covering is disclosed for the sole plate of the iron.

U.S. Pat. No. 3,905,138 issued on Sep. 16, 1975 to Antonio Abolafia describes a Steam Iron Shoe, comprising a metal plate and a PTFE coating sandwiching a fabric layer therebetween. The result is a rigid assembly, which must be specially formed for different iron sole plate configurations. The Abolafia plate attachment more closely resembles the Jacobson plate attachment discussed further above, than the present plate attachment formed entirely of a thin PTFE sheet. Conventional coil springs are used to secure the Abolafia plate attachment to the sole plate, as in the case of Jacobson and Resnick, as well as the present cover.

U.S. Pat. No. 3,930,325 issued on Jan. 6, 1976 to Robert L. Schaeffer et al. describes Steam Iron Soleplate Construction with the sole plate formed from relatively thin sheet material, rather than cast. Schaeffer et al. note that such material may be coated with PTFE, as is known in the art, but are silent regarding any PTFE cover which may be removably secured to the sole plate.

U.S. Pat. No. 4,209,921 issued on Jul. 1, 1980 to Josef Kochauf describes a Flat Iron Foil formed of a thicker sheet of PTFE than that used in the present invention. The Kochauf PTFE has a plurality of ridges along the upper surface, to space the steam vent holes from the bottom of the iron sole plate. This is needed, as Kochauf does not particularly align his steam holes with those in the iron sole plate, as noted in column 3, lines 11–13 of his patent. Without the ribs, the extremely small surface area of each collar of the holes would produce significant localized pressure against the sole plate, thus blocking steam flow. In the present cover, a myriad of steam vent holes are provided through the thin sheet in a pattern generally aligned with the conventional steam hole pattern in the sole plate of an iron, so at least some of the holes in the cover will be generally aligned with the steam outlet holes in the sole plate of the iron. Also, as the Kochauf cover is spaced from the sole plate by the ribs and/or steam vent opening ridges, there is some question of even heat transfer due to the air gap between the iron sole plate and the PTFE cover. The present sole plate cover is formed as a uniform, flat, planar sheet devoid of protuberances, and is in continuous, unbroken contact with the iron sole plate when installed. Also, the Kochauf ribs and steam vent opening ridges would allow a relatively thin sheet of PTFE plastic material to collapse between those ribs and ridges when the weight of the iron was resting thereon, with the cover being compressed between the iron and the compliant underlying fabric material. This is even more true when the material is heated by the iron and/or steam and becomes relatively soft and pliable. The resulting collapse of the sheet between the ribs and vent opening ridges, would result in uneven pressure on the underlying clothing or other fabric material being ironed, and a relatively inefficient means of removing wrinkles and smoothing the fabric.

U.S. Pat. No. 4,642,922 issued on Feb. 17, 1987 to Giorgio Prudenziati describes a Removable Steam Iron Sole Plate comprising a specially formed iron having a sole plate with a shallow depression therein. A rigid perforated stainless steel plate is removably secured therein by screws. No PTFE coating, removable or otherwise, is disclosed.

U.S. Pat. No. 4,660,307 issued on Apr. 28, 1987 to John W. Fay describes a Cover For Film Irons, as used in adhesively attaching and heat shrinking plastic sheet (e.g., Monokote, tm) to model aircraft structures. The use of permanently bonded PTFE coatings to such irons is known, as shown in column 1, lines 16–19 of the patent, similar to bonding a PTFE film to conventional fabric irons. The Fay patent is directed to a fabric cover which is removably securable over the iron head, to preclude scratching the plastic sheet if the PTFE coating of the iron is damaged.

U.S. Pat. No. 4,665,637 issued on May 19, 1987 to Carolyn M. Kramer describes a Sole Plate Coating For A Fabric Pressing Device comprising a ceramic layer bonded to the metal sole plate of the iron. No PTFE material is disclosed, nor is the ceramic coating removable from the iron, as is the PTFE plastic sheet of the present invention.

U.S. Pat. No. 4,747,222 issued on May 31, 1988 to Gunther Riba describes a High-Pressure Steam Flatiron, with the primary object being an iron which is simpler and less expensive to produce. Accordingly, no PTFE or other coatings of the sole plate are disclosed by Riba.

U.S. Pat. No. 4,800,661 issued on Jan. 31, 1989 to Hiroshi Yamamoto et al. describes an Electric Iron having a PTFE coating on the sole plate thereof. The PTFE is adulterated with a metallic powder to reduce electrostatic differences between the sole plate and fabric being ironed, as well as to provide better heat transfer. A resin may also be added to provide a harder coating. Yamamoto et al. recognize that PTFE plastic will soften and be subject to greater wear when exposed to the heat of a typical iron, as noted in column 1, lines 26–36 and FIG. 6 of their disclosure. Their response is by means of altering the chemical structure of the PTFE coating on the sole plate, rather than making a separate and removable PTFE sheet for such sole plates, as provided by the present invention. It is desirable that the PTFE sheet of the present invention soften under heat to a certain degree, to conform to different iron sole plates.

U.S. Pat. No. 4,856,212 issued on Aug. 15, 1989 to Joseph Dikoff describes a Cordless Iron With High-Temperature, Non-Scorching Sole Plate Surface. The material used for the sole plate coating is a polyamide film provided by the DuPont Corporation under the trademark name, "Kapton." The material has somewhat more stable properties at high temperatures than does PTFE. Dikoff provides his coating as a thin film which is permanently bonded to the sole plate, rather than as a removable sheet, as in the present invention.

U.S. Pat. No. 5,164,244 issued on Nov. 17, 1992 to Henry Mattesky describes the Non-Staining Lubrication Of Laundry Iron Soles, wherein a fabric sheet impregnated with a silicone elastomer (not PTFE) is provided over which the hot iron is passed. Some friction reducing agent from the elastomer is transferred to the iron sole plate, enabling the iron to be passed more easily over articles being pressed. No removable PTFE sheet for the iron sole plate is provided by Mattesky.

U.S. Pat. No. 5,165,184 issued on Nov. 24, 1992 to Claudine Gardaz et al. describes an Ironing Device Sole-Plate With Coated Ribs, including a PTFE or enamel coating bonded to the sole plate. Additional reduction of friction and better bonding of the coating to the sole plate is claimed, but no disclosure is made of a removable PTFE sheet, as provided by the present invention. Moreover, the present removable PTFE sheet is smooth and planar in all directions, with the exception of steam vent holes, and contains no ribs or other protuberances.

Finally, U.S. Pat. No. 5,165,185 issued on Nov. 24, 1992 to Claudine Gardaz et al. describes an Ironing Device Sole-Plate With Resin Projections, comprising a series of spaced apart ribs extending from the PTFE coating bonded to the sole plate. The configuration is somewhat similar to the same patentee's '184 patent discussed immediately above, with the same advantages. There is some question, however, as to the smoothness of the pressing accomplished by using other than a perfectly smooth, planar pressing surface, as provided by the present iron sole plate removable PTFE sheet.

None of the above inventions and patents, taken either singly or in combination, is seen to describe the instant invention as claimed.

SUMMARY OF THE INVENTION

Accordingly, it is a principal object of the invention to provide an improved removable sole plate cover for fabric pressing irons, comprising a thin, flexible sheet of PTFE plastic material which is completely flat and planar and devoid of any protuberances, thereby providing for complete and unbroken contact of the cover over the entire surface of the iron sole plate.

It is another object of the invention to provide an improved iron sole plate cover which includes a myriad of steam vent holes therethrough, arranged in a generally V shaped pattern generally overlying the conventionally arranged steam vent holes in a hand operated fabric pressing steam iron.

It is a further object of the invention to provide an improved iron sole plate cover which steam vent holes comprise substantially two hundred holes each having a diameter of substantially one sixteenth of an inch, and which PTFE sheet is substantially fifteen thousandths of an inch thick.

Still another object of the invention is to provide an improved iron sole plate cover including peripheral flaps having eyelets therethrough adapting the sheet for removable attachment to the sole plate of an iron by at least one tensile spring.

It is an object of the invention to provide improved elements and arrangements thereof in an apparatus for the purposes described which is inexpensive, dependable and fully effective in accomplishing its intended purposes.

These and other objects of the invention will become apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
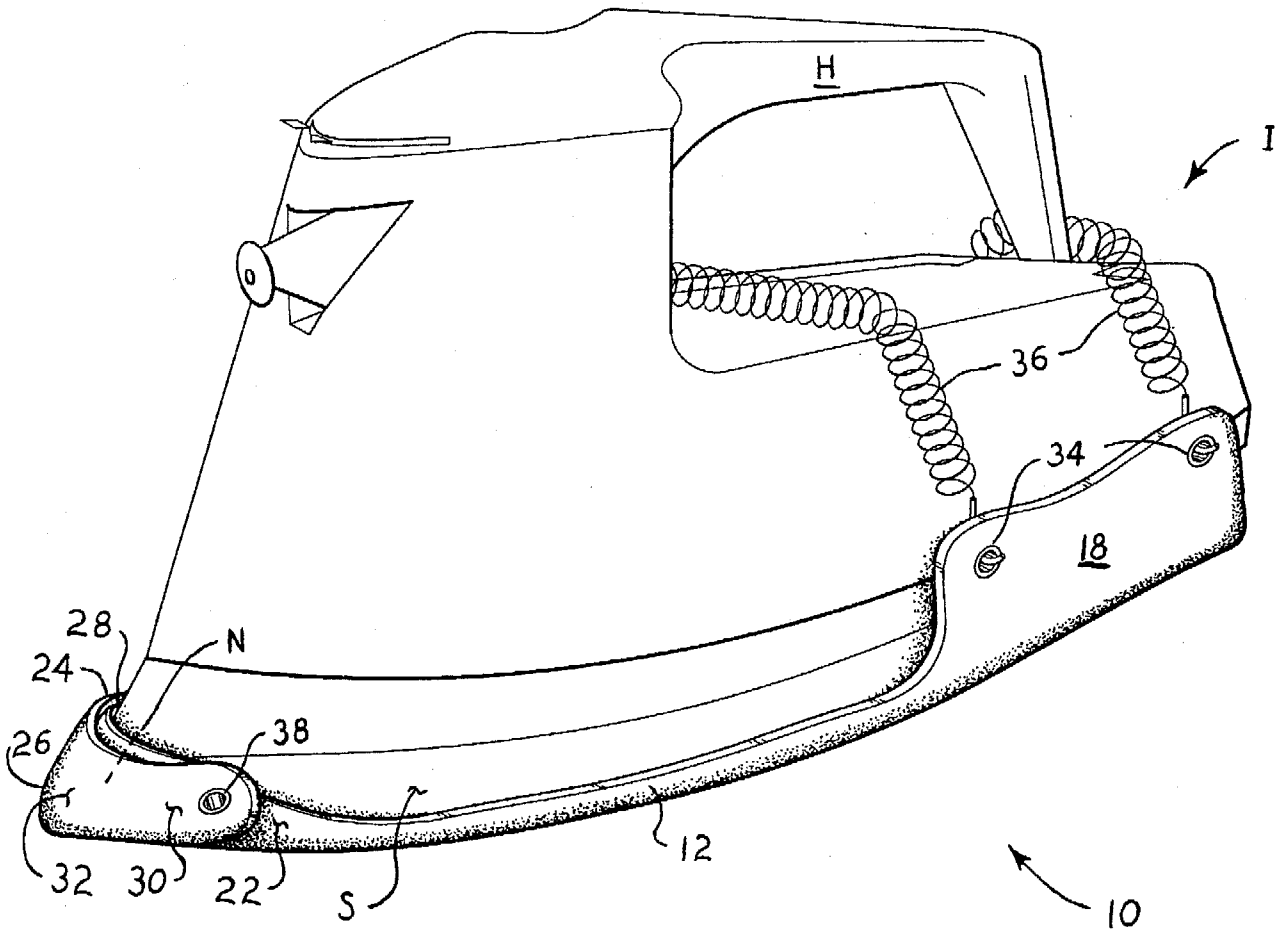
FIG. 1 is a perspective view of a hand operated fabric pressing iron with the present protective shield or cover installed thereon.

The present invention comprises a removable sole plate cover 10 for a conventional hand operated fabric pressing iron I, as shown in FIG. 1. The cover 10 is formed of a very thin sheet of polytetrafluroethylene (PTFE) material, an example of which is manufactured and sold by the DuPont Corporation under the trademark name, "Teflon." This material is well known for its low coefficient of friction, and has reasonably good characteristics when exposed to heat. However, the material is relatively soft and prone to wear, which results in the material wearing away over a period of time when used as a permanent coating for the sole plates of fabric pressing irons, the interiors of cooking utensils, etc.

Accordingly, the present invention provides a removable sheet 10 of the material, enabling it to be replaced as required. While the material has reasonably good heat resistance, it will soften and become pliable when exposed to the typical heat of a household fabric pressing iron, thus enabling the present removable cover 10 to comply with the specific shape of a household iron I to which it is removably secured, to enable a single size, or at most a few different sizes, of such a cover 10 to be provided in a flat, planar state to fit various different sizes and shapes of iron sole plates S, and to conform pliably to such sole plates S when first secured to the iron I and the iron I is heated. The actual melting point of PTFE material is about 500 degrees Fahrenheit (260° C.), while the typical household iron can produce only about 350 degrees F. (177° C.) as a maximum. Thus, the present cover 10 will not melt in normal use.

Figure 2:
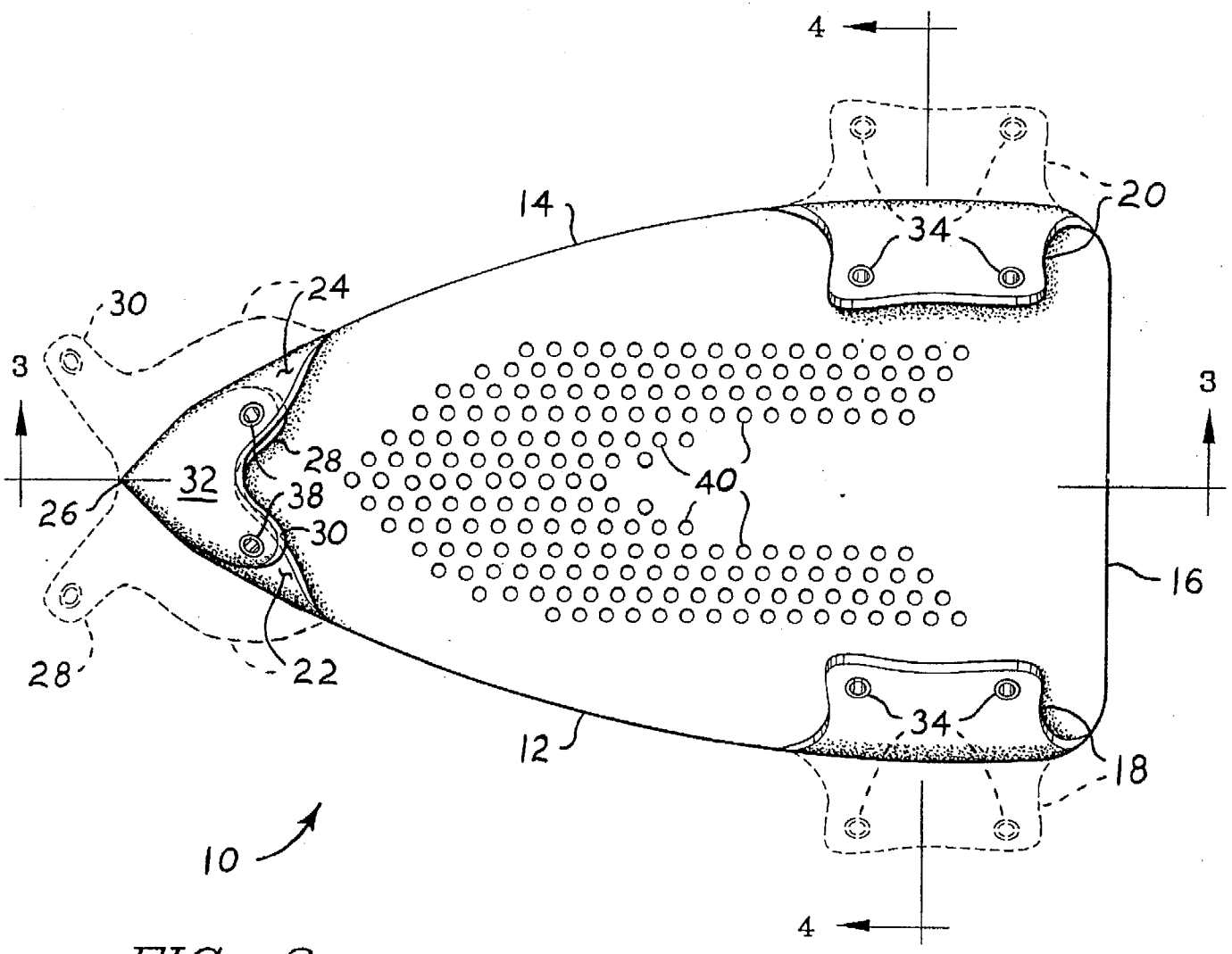
FIG. 2 is a top plan view of the present cover or shield, showing further details of its construction.

FIG. 2 provides a top plan view of the present cover 10, and discloses further details. The cover 10 is formed of a very thin, flat, planar sheet of PTFE material, as noted above, preferably having a thickness on the order of 0.015" (fifteen thousandths of an inch, or about one sixty fourth of an inch (3.81 mm); it will be noted that this thickness is somewhat exaggerated in the drawing figures, for clarity). The cover 10 is formed in the general shape of the typical conventional household hand operated fabric pressing iron I, having a generally V-shaped configuration with symmetrically disposed opposite first and second convex curvilinear sides 12 and 14, and a generally straight rearward edge 16. A rearwardly disposed first and an opposite second lateral flap 18 and 20 extend respectively from the first and second sides 12 and 14 adjacent the rearward edge 16, and a laterally extending first and opposite second flap 22 and 24 extend respectively from the two sides 12 and 14 adjacent the apex 26 of the cover 10. Each of these forward flaps 22 and 24 includes a forwardly and laterally extending ear, respectively 28 and 30, which are used to form a pocket 32 about the nose N of the iron sole plate S.

These flaps 18 through 24 and ears 28 and 30 are shown in broken lines in their unfolded state in FIG. 2, where they are coplanar with the remainder of the cover 10 before being formed to fit about the sole plate S of the iron I to which the cover 10 is secured. However, they will bend upwardly to fold about the sole plate S, sole plate nose N, and base of the iron I, particularly when heat is applied.

The rear flaps 18 and 20 each include at least one, and preferably two, metal eyelet(s) 34 therethrough. These eyelets 34 provide for the removable attachment of one or more tensile springs 36 thereto, which extend over the top of the iron I to draw the rear flaps 18 and 20 upward. (It should be noted that normally only a single spring 36 may be required, wrapping either about the back or in front of the rearward portion of the handle H of the iron I, according to the configuration of the iron I and its handle H. The two springs 36 shown in FIG. 1 serve to illustrate either configuration.)

The front flaps 22 and 24 and their respective extensions or ears 28 and 30 are folded upwardly to surround the nose N of the iron sole plate, and the two ears 28 and 30 are overlapped about one another and secured together during the manufacture of the present sole plate cover 10 to form a ready made pocket 32. Some form of fastener, such as the grommets or eyelets 38 shown and similar to the eyelets 34 used in the rear flaps 18 and 20 for the attachment of the spring(s) 36, are used to secure the first ear 28 to the second forward flap 24, and the second ear 30 to the first forward flap 22 to form the front pocket 32, as shown in FIGS. 1 and 2. Other types of fasteners (rivets, etc.) may be used as desired. (While the first ear 28 is shown being positioned beneath the second forward flap 24, and the second ear 30 positioned over the first forward flap 22, it should be noted that the overlying and underlying relationship of the two ears 28 and 30, and the forward flaps 22 and 24, may be reversed as desired.)

FIG. 2 also discloses the myriad of steam vent holes 40 which are provided in a symmetrical, generally V-shaped pattern through the cover 10. Preferably, about two hundred such holes 40 are provided, each having a diameter of about one sixteenth of an inch (1.6 mm). (The hole 40 diameters shown in FIG. 2 are exaggerated slightly, for clarity in the drawing figure.) The pattern of these holes 40 is generally congruent and in registry with the conventional steam vent hole pattern of most hand operated household steam irons. This sole plate pattern is not shown in the drawings, but is similar to those disclosed in U.S. Pat. No. 3,407,521 to English and 5,185,184 and '185 to Gardaz, each of which have been discussed further above.

Other steam hole patterns may be provided as desired, but by providing a myriad of holes 40 in a pattern generally congruent with the conventional steam hole outlet pattern of a conventional steam iron, at least some of the holes 40 will always be in alignment with some of the steam outlet holes of the iron, thus allowing steam to flow directly from the outlet holes of the iron and directly through the outlet holes 40 of the cover 10, thus precluding any requirement for ribs and other protuberances between the sole plate S and the cover 10 to provide space for lateral steam flow from the steam vent holes of the iron, to the steam vent holes of the cover. Accordingly, the present cover 10 can be die cut or otherwise formed from a relatively economical flat, planar sheet of PTFE material which is devoid of ribs, ridges, and other protuberances.

This formation of the present iron cover 10 of a flat, planar sheet of PTFE material which is devoid of any raised protuberances or other irregularities, also provides for more even heat distribution through the cover 10, as the entire sheet is in direct, continuous, and unbroken contact with the bottom surface of the iron sole plate S, with no air gaps or other spacing therebetween. The only exception will be seen to be the steam vent holes of the iron and steam vent holes 40 of the cover sheet 10.

Figure 3:
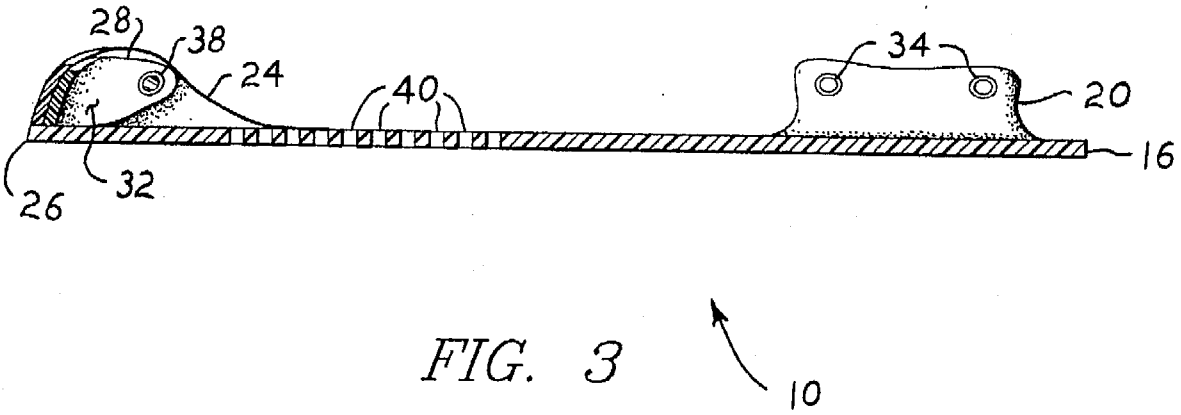
FIGS. 3 and 4 are elevation views in section respectively along lines 3—3 and 4—4 of FIG. 2.

FIG. 3 is a longitudinal cross sectional view of the right half of cover 10 along line 3—3 of FIG. 2, with the forward and rearward second lateral flaps 20 and 24 and first ear extension 28, underlying the first forward flap 24, being visible. Only the centermost row of steam vent holes 40, near the apex 26 end of the cover 10, are visible, as the two arms of the V-shaped pattern spread laterally as they extend rearwardly through the cover 10.

Figure 4:
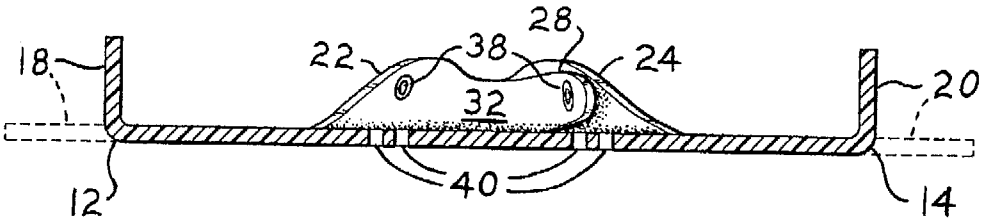

FIG. 4 provides a lateral cross sectional view along line 4—4 of FIG. 2. Here, the first and second rearward lateral flaps 18 and 20 are shown in their unformed or unfolded flat states in broken lines. Their formed configuration is shown in solid lines, as in the drawing of FIG. 2, as they would be configured after the cover 10 was installed on an iron I and heated, with the flaps 18 and 20 being drawn upwardly by the tensile spring(s) 36. The forwardmost first and second flaps 22 and 24, and first ear extension 28 underlying the second flap 24, are also shown secured together by the fasteners 38. Only some of the most rearwardly disposed holes 40, at the tips of the V, are shown in FIG. 4.

In summary, the present iron sole plate cover 10 will be seen to provide a most useful and economical accessory for irons which may not have been originally provided with a low friction PTFE coating for the sole plate, or which coating may have become worn and damaged through use. The present cover 10 may be manufactured very economically, as the flat, planar PTFE sheet material from which it is formed requires no special molds or dies for the formation of ribs or other protuberances, as is the case with at least one other PTFE sole plate cover.

The present cover 10 is easily secured removably to the sole plate S of an iron I, merely by placing the iron I atop the cover 10 and extending the tensile spring(s) 36 laterally across the top of the iron I, as shown in FIG. 1. The iron is then operated normally, with the heat developed therefrom serving to mold the cover 10, and its attachment flaps 18 through 24 extending therefrom, to the specific configuration of the sole plate S of the particular iron I to which it is secured.

The PTFE material of the present cover 10 provides very even heat and steam distribution from the iron I to preclude scorching, burning, or polishing of fabric being pressed, as the cover 10 is in contact with the sole plate S of the iron I continually across its entire length and span, with the exception of any steam vent holes in the iron sole plate and the vent holes 40 of the cover 10. No ribs or protrusions are required between the iron sole plate S and the cover 10, as the steam holes of the sole plate and cover 10 are essentially in registry with one another.

Even if some of the iron sole plate steam vent holes 40 were to be blocked, it will be seen that the steam pressure would cause the steam to spread laterally between the sole plate and the cover 10, to flow through the cover steam holes 40. The ribs, and particularly the ridges around the steam outlet holes of other such attachments, would create a sufficiently high localized pressure bearing against the bottom of the iron sole plate, that the relatively low steam pressure within the iron would be unable to overcome the sealing effect of such protuberances, and steam flow unable to flow to the cover outlet holes would be forced laterally outward about the edges of the cover, thus creating a hazard to the user of the device and being ineffectual at providing the desired moist heat for pressing fabric.

The present cover 10 overcomes this problem by means of its flat, planar surfaces, which result in a relatively low localized pressure at any one point between the cover 10 and the iron sole plate S. Thus, any steam which does not flow directly through the steam holes 40 of the cover 10 will be able to overcome such relatively low and uniform contact pressure between the sole plate S and the cover 10, and will flow between the sole plate S of the iron I and the cover 10 to other outlet holes 40, and will not be blocked by ribs, ridges, and protuberances extending from the surface of the cover 10 between the cover 10 and the sole plate S.

In the event that maintenance is required (cleaning of steam passages, etc.) for an iron I having the present cover 10 installed thereon, the cover 10 may be removed by merely unhooking the spring(s) 36 from either attachment end with a corresponding eyelet 34, withdrawing the nose N of the sole plate S from the formed pocket 32 of the cover 10, and lifting the iron from the cover 10. The original cover 10, having been molded by heat from the iron I to conform generally to the shape of the sole plate S, may be replaced on the sole plate S by reattaching the appropriate spring(s) 36 to its/their corresponding eyelets 34. If the cover 10 is damaged or worn beyond practicable use, another new cover 10 may be easily installed thereon, as described above. The present cover 10 will thus be seen to provide a most economical means of protecting fabrics being pressed with a hand operated pressing iron, and will pay for itself many times over in the protection of fine fabrics and articles of clothing.

It is to be understood that the present invention is not limited to the sole embodiment described above, but encompasses any and all embodiments within the scope of the following claims.

We claim:

1. A removable sole plate cover for a fabric pressing iron, comprising:

a thin, flexible, flat, planar sheet of polytetrafluoroethylene plastic material, devoid of protuberances;

said cover being formed in the general configuration of the sole plate of a conventional hand operated fabric pressing iron, and including forwardly and rearwardly disposed opposite first and second lateral flaps of material extending therefrom, with said rearwardly disposed flaps including at least one attachment eyelet formed therethrough and providing for the removable attachment of said cover to a fabric pressing iron;

said forwardly disposed first and second flaps each respectively having a first and a second extension ear extending forwardly therefrom, with each said first and said second extension ear being folded respectively to underlay and overlay said second and said first forwardly disposed flaps, and being respectively secured thereto by a fastener;

said cover including a myriad of steam vent holes therethrough with said holes being distributed in a generally V shaped pattern conforming to the conventional steam vent hole pattern in the sole plate of a steam iron, with at least some of said steam vent holes of said cover being disposed in registry with at least some of the steam vent holes of the iron sole plate when said cover is removably installed over the sole plate of the iron, and;

said cover being adapted to provide direct, continuous, unbroken contact with the sole plate of the iron and completely thereover when said cover is removably secured thereto, excepting said steam vent holes of said cover and any steam vent holes of the sole plate of the iron, whereby;

said cover is removably installed to the iron and provides even heating and steam distribution to articles being ironed, while precluding burning, scorching, and polishing of such articles.

2. The removable sole plate cover according to claim 1 including:

at least one tensile spring removably attachable respectively between a corresponding said eyelet of said first and said second rearwardly disposed flaps, and adapted to extend laterally across the top of the iron to secure said cover removably to the iron as desired.

3. The removable sole plate cover according to claim 2, wherein:

each said eyelet is formed of metal.

4. The removable sole plate cover according to claim 1, wherein:

each said eyelet is formed of metal.

5. The removable sole plate cover according to claim 1, wherein:

said fastener securing a respective one said extension ear to a corresponding one of said forwardly disposed flaps, comprises a metal eyelet.

6. The removable sole plate cover according to claim 1, wherein:

said sheet of material has a substantially uniform thickness of substantially fifteen thousandths of an inch.

7. The removable sole plate cover according to claim 1, wherein:

said steam vent holes in said cover comprise substantially two hundred holes symmetrically distributed laterally through said cover.

8. The removable sole plate cover according to claim 7, wherein:

each of said steam vent holes in said cover has a diameter of substantially one sixteenth of an inch.

9. The removable sole plate cover according to claim 1, wherein:

each of said steam vent holes in said cover has a diameter of substantially one sixteenth of an inch.

10. A fabric pressing iron, and a removable sole plate cover therefor comprising in combination:

a hand operated fabric pressing iron having a sole plate with a plurality of steam vent holes therethrough and distributed in a generally V-shaped pattern;

a sole plate cover comprising a thin, flexible, flat, planar sheet of polytetrafluoroethylene plastic material, devoid of protuberances;

said cover being formed in the general configuration of the sole plate of a conventional hand operated fabric pressing iron, and including forwardly and rearwardly disposed opposite first and second lateral flaps of material extending therefrom, with said rearwardly disposed flaps including at least one attachment eyelet formed therethrough and providing for the removable attachment of said cover to a fabric pressing iron;

said forwardly disposed first and second flaps each respectively having a first and a second extension ear extending forwardly therefrom, with each said first and said second extension ear being folded respectively to underlay and overlay said second and said first forwardly disposed flaps, and being respectively secured thereto by a fastener;

said cover including a myriad of steam vent holes therethrough, with said holes being distributed in a generally V shaped pattern generally conforming to said steam vent hole pattern in said sole plate of said iron, with at least some of said steam vent holes of said cover being disposed in registry with at least some of said steam vent holes of said sole plate of said iron when said cover is removably installed over said sole plate of said iron, and;

said cover being adapted to provide direct, continuous, unbroken contact with said sole plate of said iron and completely thereover when said cover is removably secured thereto, excepting said steam vent holes of said cover and said steam vent holes of said sole plate of said iron, whereby;

said cover is removably installed to said sole plate of said iron and provides even heating and steam distribution to articles being ironed, while precluding burning, scorching, and polishing of such articles.

11. The fabric pressing iron and removable sole plate cover combination according to claim 10, including:

tensile springs removably attachable respectively between each said eyelet of said first and said second forwardly disposed flaps and each said eyelet of said first and said second rearwardly disposed flaps, and adapted to extend laterally over said iron to secure said cover removably to said iron as desired.

12. The fabric pressing iron and removable sole plate cover combination according to claim 11, wherein:

each said eyelet is formed of metal.

13. The fabric pressing iron and removable sole plate cover combination according to claim 10, wherein:

each said eyelet is formed of metal.

14. The removable sole plate cover according to claim 10, wherein:

said fastener securing a respective one said extension ear to a corresponding one of said forwardly disposed flaps, comprises a metal eyelet.

15. The fabric pressing iron and removable sole plate cover combination according to claim 10, wherein:

said sheet of material has a substantially uniform thickness of substantially fifteen thousandths of an inch.

16. The fabric pressing iron and removable sole plate cover combination according to claim 10, wherein:

said steam vent holes in said cover comprise substantially two hundred holes symmetrically distributed laterally through said cover.

17. The fabric pressing iron and removable sole plate cover combination according to claim 16, wherein:

each of said steam vent holes in said cover has a diameter of substantially one sixteenth of an inch.

18. The fabric pressing iron and removable sole plate cover combination according to claim 10, wherein:

each of said steam vent holes in said cover has a diameter of substantially one sixteenth of an inch.

* * * * *